US007667618B2

(12) United States Patent
Chitor et al.

(10) Patent No.: US 7,667,618 B2
(45) Date of Patent: Feb. 23, 2010

(54) SYSTEM AND METHOD FOR TRACKING AND BILLING VEHICLE USERS BASED ON WHEN AND IN WHICH ROAD LANES THEIR VEHICLES HAVE BEEN DRIVEN

(75) Inventors: Ramesh Chitor, Fremont, CA (US); Christopher J. Strauss, Trabuco Canyon, CA (US); Nam Keung, Austin, TX (US); Sebnem Jaji, Flower Mound, TX (US)

(73) Assignee: International Business Machines Corporation, Armonk, NY (US)

( * ) Notice: Subject to any disclaimer, the term of this patent is extended or adjusted under 35 U.S.C. 154(b) by 291 days.

(21) Appl. No.: 11/738,504

(22) Filed: Apr. 22, 2007

(65) Prior Publication Data

US 2008/0258936 A1 Oct. 23, 2008

(51) Int. Cl.
*G08G 1/01* (2006.01)

(52) U.S. Cl. ..... 340/933; 342/44; 342/456

(58) Field of Classification Search ... 340/572.1–572.9, 340/933, 935; 342/44, 456
See application file for complete search history.

(56) References Cited

U.S. PATENT DOCUMENTS

| | | | | | |
|---|---|---|---|---|---|
| 5,101,200 | A * | 3/1992 | Swett | ..... | 340/937 |
| 5,190,302 | A * | 3/1993 | Trotta | ..... | 280/35 |
| 5,289,183 | A | 2/1994 | Hassett et al. | | |
| 5,310,999 | A * | 5/1994 | Claus et al. | ..... | 235/384 |
| 5,485,520 | A * | 1/1996 | Chaum et al. | ..... | 705/74 |
| 5,819,234 | A * | 10/1998 | Slavin et al. | ..... | 340/10.4 |
| 6,008,621 | A * | 12/1999 | Madison et al. | ..... | 320/107 |
| 6,055,571 | A | 4/2000 | Fulp et al. | | |
| 6,411,889 | B1 * | 6/2002 | Mizunuma et al. | ..... | 701/117 |
| 6,525,673 | B1 * | 2/2003 | Feldman | ..... | 340/928 |
| 7,091,880 | B2 * | 8/2006 | Sorensen | ..... | 340/928 |
| 2002/0108539 | A1 * | 8/2002 | Dahl | ..... | 108/50.01 |
| 2003/0020634 | A1 | 1/2003 | Banerjee et al. | | |
| 2003/0039212 | A1 | 2/2003 | Lloyd | | |
| 2004/0119609 | A1 | 6/2004 | Solomon | | |
| 2005/0165537 | A1 | 7/2005 | Dort | | |
| 2009/0018761 | A1 * | 1/2009 | Petrisor | ..... | 701/118 |

* cited by examiner

*Primary Examiner*—Davetta W Goins
*Assistant Examiner*—Edny Labbees
(74) *Attorney, Agent, or Firm*—Steven Lieske Bennett

(57) ABSTRACT

A system includes one or more transponders, a number of sensors, a tracking sub-system, and a billing sub-system. Each transponder is located in a vehicle capable of being driven on a road having at least a first lane and a second lane in which vehicles move in a same direction. Each sensor is movably located at a point along the road to detect the transponder of each vehicle that has changed between the first and the second lanes at the point. The tracking system is communicatively coupled to the sensors to track when and at which of the points the vehicles have changed between the first and the second lanes. The billing system is to periodically bill users of the vehicles based on when and where the vehicles are driven in the second lane of the road.

20 Claims, 6 Drawing Sheets

SYSTEM AND METHOD FOR TRACKING AND BILLING VEHICLE USERS BASED ON WHEN AND IN WHICH ROAD LANES THEIR VEHICLES HAVE BEEN DRIVEN

FIELD OF THE INVENTION

The present invention relates to tracking and billing vehicle users based on when and in which lanes their vehicles have been driven.

BACKGROUND OF THE INVENTION

While there are a number of different travel options available to most people, including such mass-transit options like buses, subways, and commuter trains, a large number of people still use their own vehicles to travel between home and work, as well as to travel to other locations. With increasing populations, the number of miles being driven nationwide has dramatically increased. Government budgets for new roads and new lanes on existing roads have not kept pace with the increasing usage of roads, however, resulting in traffic gridlock on many major metropolitan roads for ever-increasing lengths of time during the day.

Therefore, other mechanisms have been introduced in order to reduce traffic congestion. One popular option is the carpool, or "high-occupancy vehicle" (HOV), lane. For roads having more than one lane traveling in the same direction, a lane is designated as a carpool or HOV lane for at least certain times of the day. During these times, only vehicles having a designated number of occupants, including the driver, are permitted to drive on these carpool or HOV lanes.

Carpool or HOV lanes, however, have not proven to be as successful in reducing traffic congestion as had been hoped. Many drivers cannot or do not want to carpool with other people in order to be able to drive on these lanes. As a result, traffic department planners are in a difficult position. They cannot build new roads or lanes on existing roads, due to lack of money, and drivers have not been taking advantage of carpool or HOV lanes in the numbers that were hoped. As such, traffic congestion continues, and appears to be getting worse.

SUMMARY OF THE INVENTION

The present invention relates to tracking and billing vehicle users based on when and in which road lanes their vehicles have been driven. A system of one embodiment of the invention includes one or more transponders, a number of sensors, a tracking sub-system, and a billing sub-system. Each transponder is located in a vehicle capable of being driven on a road having at least a first lane and a second lane in which vehicles move in a same direction. Each sensor is movably located at a point along the road to detect the transponder of each vehicle that has changed between the first and the second lanes at the point. The tracking system is communicatively coupled to the sensors to track when and at which of the points the vehicles have changed between the first and the second lanes. The billing system is to periodically bill users of the vehicles based on when and where the vehicles are driven in the second lane of the road.

A device of one embodiment of the invention can be disposed within a vehicle that is capable of being driven on a road having at least a first lane and a second lane in which vehicles move in the same direction. The device includes a transponder to output whether the vehicle is in the first lane or the second lane of the road. The transponder communicates with sensors located at points along the road to convey at which of these points the vehicle changes between the first and the second lanes. The device can further include a wireless receiver to receive information regarding the cost for switching from the first lane to the second lane at a current point along the road and to convey this information to the vehicle's driver.

A method of an embodiment of the invention includes sensors located at different points along a road having at least a first lane and a second lane in which vehicles move in the same direction detecting that a vehicle has changed between the first and the second lanes of the road. The sensors communicate this detection of the vehicle having changed between the first and the second lanes to a tracking component. The tracking component tracks when and at which of the different points the vehicle changed between the first and the second lanes. A billing component periodically bills a user of the vehicle based on when and where the vehicle was driven in the second lane of the road.

Embodiments of the invention provide for advantages over the prior art. The cost of a driver switching from a first lane of a road, such as a regular-traffic lane, to a second lane of a road, such as an express, carpool, or high-occupancy vehicle (HOV) lane, may change based on current traffic conditions on the road. For example, as traffic increases, the cost for a driver to switch to the second lane may increase. Therefore, each driver of each vehicle on the road is able to make his or her own decision as to whether it is worth the cost that will be incurred to travel more quickly on the road in the second lane, as opposed to more slowly in the first lane.

Since the cost for driving in the faster lane of traffic increases as traffic increases, presumably the economically optimal number of vehicles will travel in the faster lane at any given time. At times of lesser traffic, the cost to switch to the faster lane is likely less. but the incentive for a driver to switch to the faster lane is less. Likewise, at times of greater traffic, the cost to switch to the faster lane is increased, corresponding with a presumably greater incentive for a driver to switch to the faster lane. The transponders, sensors, and sub-systems of the invention permit such variable-cost traffic planning to be achieved in order to reduce traffic congestion.

Furthermore, the system is a relatively low-cost way to implement variable-cost traffic planning. Sensors may just be needed along areas of a road in which there commonly traffic bottlenecks. Furthermore, the sensors may be movable. As such, during special events like sporting events in which traffic bottlenecks temporally change, department of transportation workers can easily move the sensors to different locations for temporary periods of time. Still other advantages, aspects, and embodiments of the invention will become apparent by reading the detailed description that follows, and by referring to the accompanying drawings.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Overview and Operation

Figure 1:
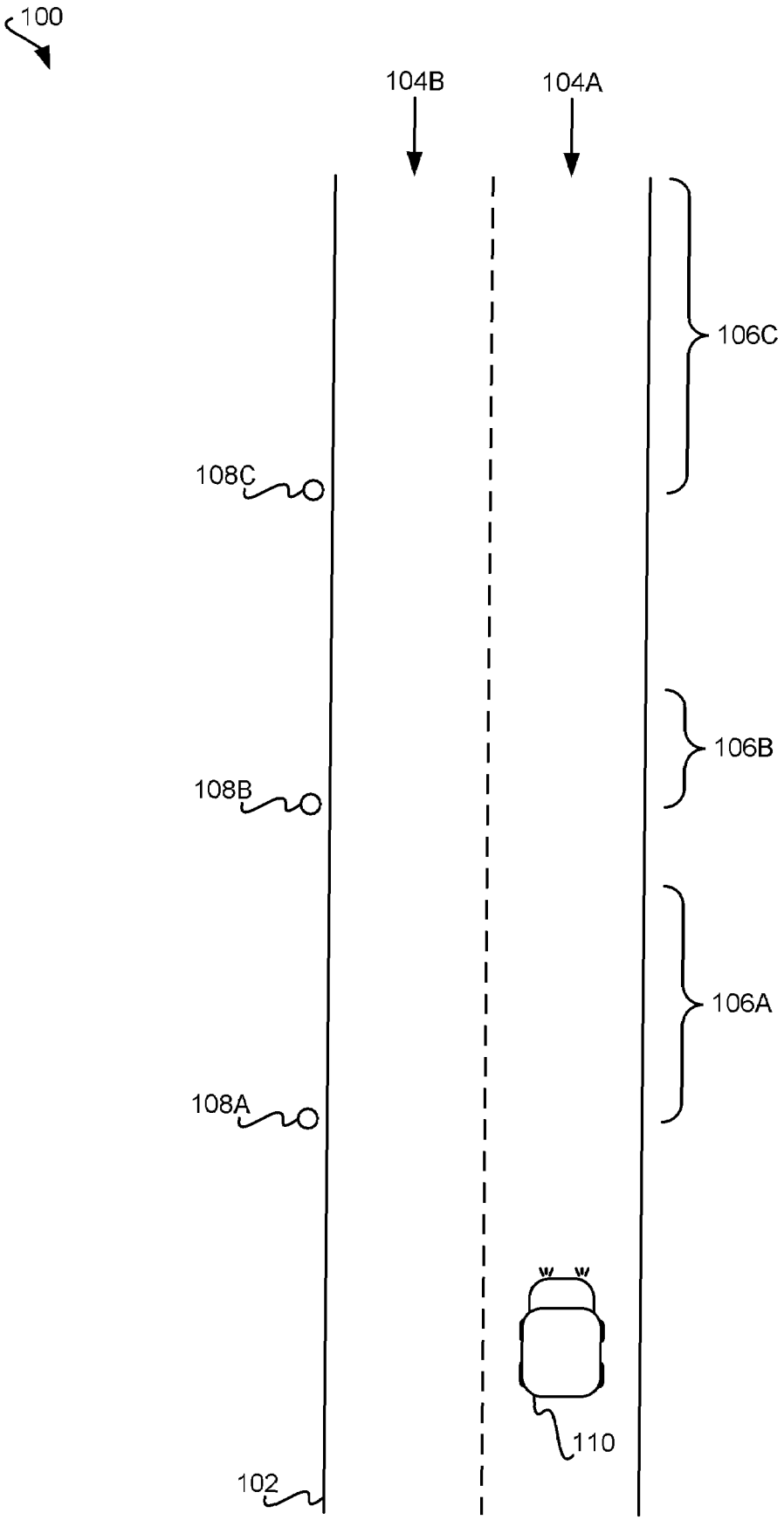
FIG. 1 is a diagram of a traffic scenario, according to an embodiment of the invention.

FIG. 1 shows a traffic scenario 100, in relation to which an embodiment of the invention is described. A road 102 includes a first lane 104A and a second lane 104B, collectively referred to as the lanes 104. Vehicles, such as the vehicle 110, are driven on both of the lanes 104 in the same direction. For example, the lanes 104 of the road 102 may be two lanes of a four-lane highway, where two lanes are for travel in one direction, and two lanes are for travel in another direction. The vehicle 110 has a single occupant, the driver of the vehicle 110.

The lane 104A is open to all traffic, regardless of the number of occupants in each vehicle, and can be referred to as a regular lane. By comparison, the lane 104B is open just to reserved traffic, such as buses, as well as carpool vehicles in which at least a designated number of people, such as two, are riding. The lane 104B is also open to other traffic, as will be described. The lane 104B can be referred to as an express lane. This is because in general, when the traffic conditions on the road 102 deteriorate, the number of vehicles within the lane 104B is likely to be less than the number of vehicles within the lane 104A, such that traffic on the lane 104B moves faster than traffic on the lane 104A does.

Traffic planners may after study have determined that areas 106A, 106B, and 106C, collectively referred to as the areas 106, are traffic bottlenecks during rush hour and other times during the day. Therefore, sensors 108A, 108B, and 108C, collectively referred to as the sensors 108, are installed at these points along the road 102. The areas 106 differ in their length, such that in the example of FIG. 1, the area 106C is longer than the area 106B, which is longer than the area 106A. The traffic planners can associate costs that users of single-occupant vehicles, such as the vehicle 110, are to incur in order to change from the regular, slower lane 104A to the express, faster lane 104B. These costs may increase and decrease throughout the day, either in accordance with a predetermined traffic model, or in relation to detected traffic conditions on the road 102. In general, as traffic gets worse, the cost for driving in the lane 104B within the sections 106 may increase, and as traffic gets better, the cost may decrease.

For example, the area 106A may have particularly bad traffic during the morning hours, the area 106B may become overly congested during the evening hours, and the area 106C may be a traffic bottleneck from the morning through the evening. During non-peak hours, it may cost a driver $X to drive in the express lane 104B (i.e., switch from the lane 104A to the lane 104B) within the areas 106. During peak hours, it may cost a driver $Y to drive in the express lane 104B within the areas 106A and 106B, where the peak hours for the area 106A include the morning hours, and the peak hours for the area 106B include the evening hours, where Y is greater than X. By comparison, traffic may be even more congested within the area 106C during its peak hours as compared to that within the areas 106A and 106B during their peak hours. Therefore, it may cost a driver $Z to drive in the express lane 104B within the area 106C throughout the day during peak hours, where Z is greater than Y.

The driver of the vehicle 110 can be notified at the beginning of each of the areas 106 what the current cost is to switch from the lane 104A to the lane 104B while driving on the road 102. Therefore, the driver decides whether he or she is willing to bear the cost for traveling on the faster express lane 104B. If the driver changes from the lane 104A to the lane 104B within the area 106B during the peak hours for the area 106B, the user of the vehicle 110 (who may or may not be the driver) is billed for $Y, and otherwise is billed for $X. If the driver thereafter remains in the express lane 104B when the vehicle 110 reaches the area 106B, the user is then billed another $Y or $X, depending on whether it is a peak time for the area 106B. Likewise, if the driver remains in the express lane 104B when the vehicle 110 reaches the area 106C, the user is billed $Z or $X, depending on whether it is a peak time for the area 106C.

Furthermore, the driver of the vehicle 110 can be notified at the beginning of each of the areas 106 what credit he or she will receive if the driver switches from the express lane 104B to the regular lane 104A. In one embodiment, the credit may be equal to a percentage of the cost $X, $Y, or $Z that is incurred when switching to the express lane 104B within these areas 106. Thus, for example, if the user is in the middle of the area 106C in the express lane 104B, and changes back to the regular lane 104A during a peak time, the user may be credited with a percentage of $Z.

The sensors 108 detect the vehicle 110 changing between the lanes 104A and 104B, both from the lane 104A to the lane 104B and from the lane 104B to the lane 104A in their respective sections 106 of the road 102. Thus, if the driver of the vehicle 110 changes lanes within the section 106A, the sensor 108A detects this lane change. Likewise, if the driver changes lanes within the section 106B, the sensor 108B detects this lane change, and if the driver changes lanes within the section 106C, the sensor 108C detects this lane change.

For instance, the vehicle 110 may be equipped with a transponder that broadcasts an identifier that is unique to the vehicle 110. The sensors 108 thus detect the signal broadcast by the transponder, including the unique identifier of the vehicle 110, and are able to discern in which of the lanes 104 the vehicle 110 currently is traveling. As a result, the sensors 108 are able to detect when the vehicle 110 changes from the lane 104A to the lane 104B and from the lane 104B back to the lane 104A. The user of the vehicle 110, such as the registered owner or lessee of the vehicle 110, may thus be periodically billed for actual solo-occupant usage of the vehicle 110 within the express lane 104B.

The transponder can have an on/off switch. For instance, if the vehicle 110 has more than one occupant while moving down the road 102, the vehicle 110 may be permitted to travel within the express lane 104B without having to pay for this privilege. As such, the driver of the vehicle 110 can turn the transponder off, so that the sensors 108 do not detect movement of the vehicle 110 on the road 102B, and so that the user of the vehicle 110 is not billed for usage of the express lane 104B while there is more than one occupant within the vehicle 110.

The sensors 108 are movable in one embodiment of the invention. For instance, while regular rush hour traffic patterns may ordain the location of the sensors 108 at the beginning of the areas 106 as denoted in FIG. 1, there may be other times when high-traffic patterns of the road 102 deviate from these regular traffic patterns. As one example, during sporting events, when a large number of people are driving on the road 102 to a sports stadium, traffic patterns may change. Therefore, the sensors 108 can be moved to locations along the road 102, as well as other roads, that make the most sense in terms of reducing traffic congestion as much as possible by variable-express lane billing.

At or just before each of the sections 106, the driver of the vehicle 110 is desirably informed as to the current cost for entering the express lane 104B, as well as to the current credit for exiting the express lane 104B. This is especially the case insofar as the pricing may change throughout the day. In one embodiment, dynamic highway signs can be employed to inform all the vehicles traveling on the road 102, including the vehicle 110. For instance, highway signs of the type that are commonly and temporarily erected to warn users of impending construction may be employed.

In another embodiment, the vehicle 110 may be equipped with a wireless receiver that receives this information as may be broadcast by a wireless transmitter located on or near the sensors 108. The information may then be displayed on a display within the vehicle 110, or otherwise indicated to the driver of the vehicle 110. In another embodiment, the information may be broadcast over standard terrestrial or satellite radio frequencies, and displayed or otherwise indicated on the radio of the vehicle 110.

System and Device

Figure 2:
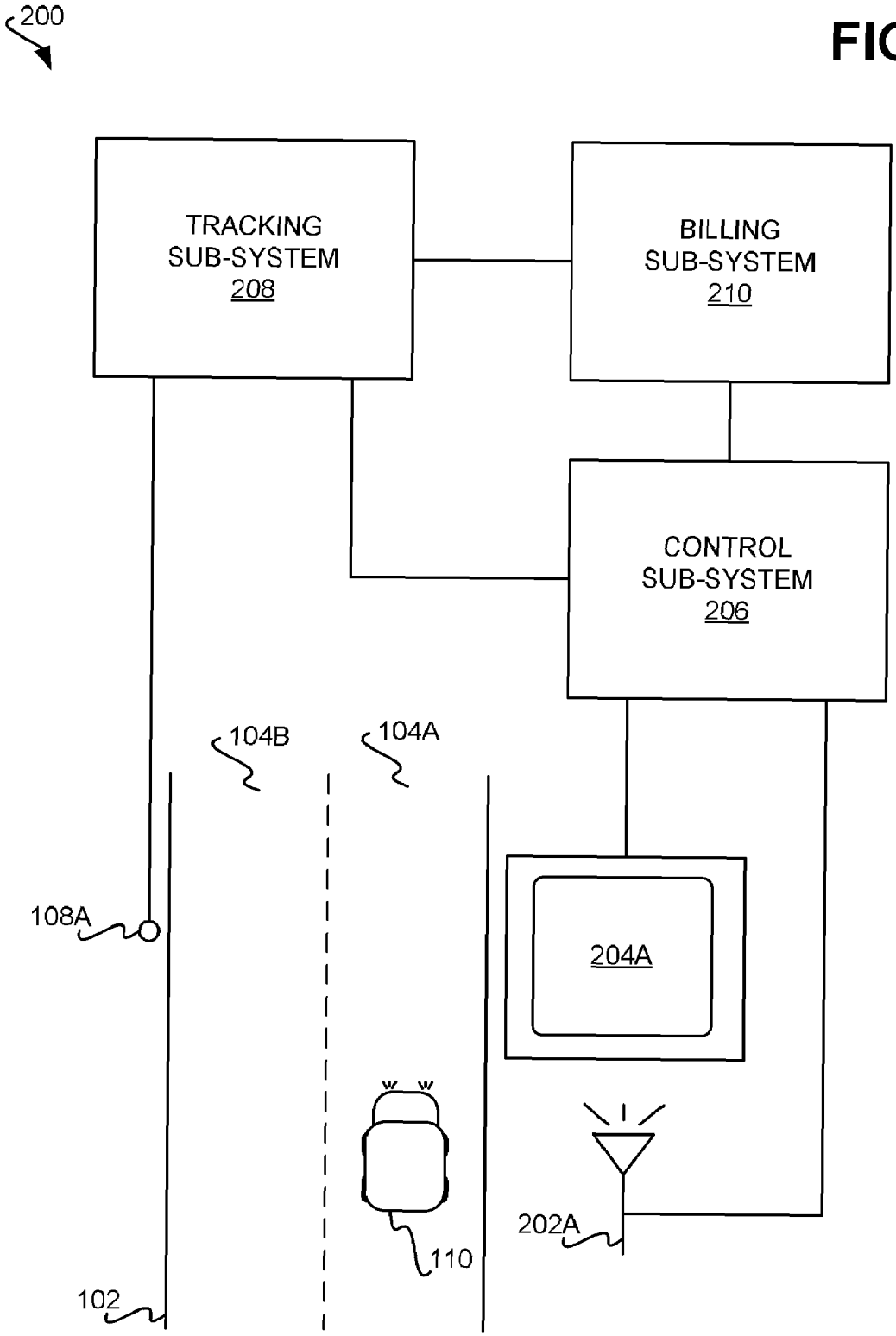
FIG. 2 is a diagram of a system for tracking and billing solo-occupant vehicle usage of an express lane of a road, according to an embodiment of the invention.

FIG. 2 shows a system 200, according to an embodiment of the invention. The system 200 includes all of the sensors 108, but just the sensor 108A is depicted in FIG. 2 for illustrative convenience. The system 200 also includes a number of display devices, such as the display device 204A corresponding to the sensor 108A, and/or a number of wireless transmitters, such as the wireless transmitter 202A corresponding to the sensor 108A. The system 200 further includes a control sub-system 206, a tracking sub-system 208, and a billing sub-system 210, each of which may be implemented in software, hardware, or a combination of software and hardware.

The display device 204A informs the driver of the vehicle 110 of the cost for switching from the lane 104A to the lane 104B, and of the credit for switching from the lane 104B to the lane 104A. The display device 204A is situated at a point along the road 102 such that the driver of the vehicle 110 has sufficient time to switch between the lanes 104A and 104B after viewing the notification displayed on the device 204A. Thus, the display device 204A may be located just before the sensor 108A, for instance.

In another embodiment, the display device 204A is co-located in a common enclosure together with the sensor 108A. As has been noted, the sensors 108 are movable for placement at different points along the road 102 at different times. As such, having the display devices and the sensors 108 co-located in common enclosures is advantageous, because it enables transportation department workers to easily move these components of the system 200 as traffic conditions warrant.

The wireless transmitter 202A is another manner by which the driver of the vehicle 110 can be informed of the cost or credit for switching between the lanes 104A and 104B. The wireless transmitter 202A wirelessly transmits this information, which is received by a wireless receiver of the vehicle 110 for display or other indication to the driver of the vehicle 110. The wireless transmitter 202A is also situated at a point along the road 102 such that the driver of the vehicle 110 has sufficient time to switch between the lanes 104A and 104B after receiving the notification transmitted by the transmitter 202A. In one embodiment, the wireless transmitter 202A is co-located in a common enclosure together with the sensor 108A.

The control sub-system 206 determines the cost and credit information to be displayed or transmitted by the display devices and the wireless transmitters. As can be appreciated by those of ordinary skill within the art, the control sub-system 206 may generate this information based on traffic pattern models. In addition, or in the alternative, this information may be determined based on real-time traffic information as detected by the sensors 108 as reported to the tracking sub-system 208, as will be described. The cost and credit information may be determined by the control sub-system 206 automatically, without user intervention, or transportation department personnel may control changing of this cost and credit information.

The tracking sub-system 208 is communicatively connected to the sensors 108, such as the sensor 108A as depicted in FIG. 2. The tracking sub-system 208 receives all the information regarding lane changes reported by the sensors 108. As such, the tracking sub-system 208 tracks when and at which points vehicles have changed between the lanes 104 of the road 102. That is, each time a vehicle changes lane, the lane change is reported by one of the sensors 108 to the tracking sub-system 208, which records this information, along with the identity of the vehicle in question and the time and date at which the lane change occurred. The control sub-system 206, as noted above, can receive this information to assist in the determination of the cost and credit structure for lane changes, in real-time.

The billing sub-system 210 uses the information recorded and tracked by the tracking sub-system 208, and the cost and credit information determined by the control sub-system 206, in order to periodically bill users of the vehicles based on when and where the vehicles are driven in the express lane 104B of the road 102. For example, on a monthly basis, the user of each vehicle that has been detected as having driven in the express lane 104B is sent a bill for this usage of the express lane 104B. The user of a vehicle may be the vehicle's owner, its registered lessee, and so on, which may or may not be the driver of the vehicle.

Figure 3:
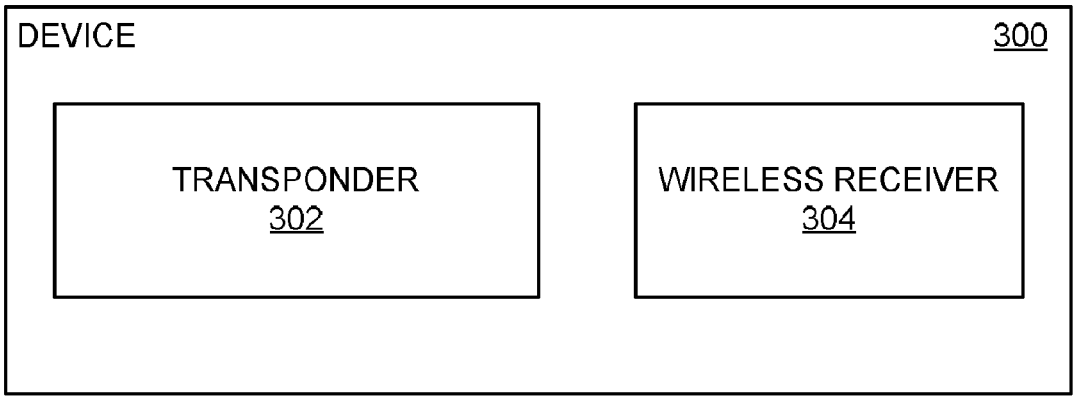
FIG. 3 is a rudimentary diagram of a device that is installed within a vehicle so that usage of the vehicle within an express lane of a road can be tracked, according to an embodiment of the invention.

FIG. 3 shows a rudimentary diagram of a device 300 that can be installed in vehicles that are capable of driving on the road 102, such as the vehicle 110, according to an embodiment of the invention. The device 300 includes a transponder 302, and in one embodiment, a wireless receiver 304 as well. As can be appreciated by those of ordinary skill within the art, the device 300 may also include other components, in addition to and/or in lieu of those depicted in FIG. 3, such as processors and memory.

The transponder 302 periodically wirelessly emits an identifier that uniquely identifies the vehicle in which the device 300 has been installed. This is the identifier that is detected by the sensors 108 to detect when the vehicle in question has entered the area of the road 102 covered by the sensor in question. This identifier may be considered a beacon that is detected by the vehicle.

In one embodiment, as has been noted, the transponder 302 may have an on/off switch. When in the on position, the switch causes the transponder 302 to emit the identifier periodically. When in the off position, by comparison, the transponder 302 does not emit the identifier periodically. A driver may wish to turn off the transponder 302 when there are other occupants in the vehicle, for instance, so that entry into the lane 104B does not result in the user of the vehicle being charged. to turn on the transponder 302 when entering into a "fee-only" roadway, which is a road designated for paying drivers regardless of the number of occupants within their vehicles.

The wireless receiver 304, where it is part of the device 300, receives cost and credit information from the wireless transmitters of the system 200, for display or other indication to the driver of the vehicle in which the device 300 is installed. Thus, in one embodiment, the wireless receiver 304 and the transponder 302 can be co-located in the same common enclosure. A user of a vehicle may purchase the device 300 for installation in his or her vehicle, so that solo drivers of the vehicle can use the express lane 104B of the road 102.

Methods and Conclusion

Figure 4:
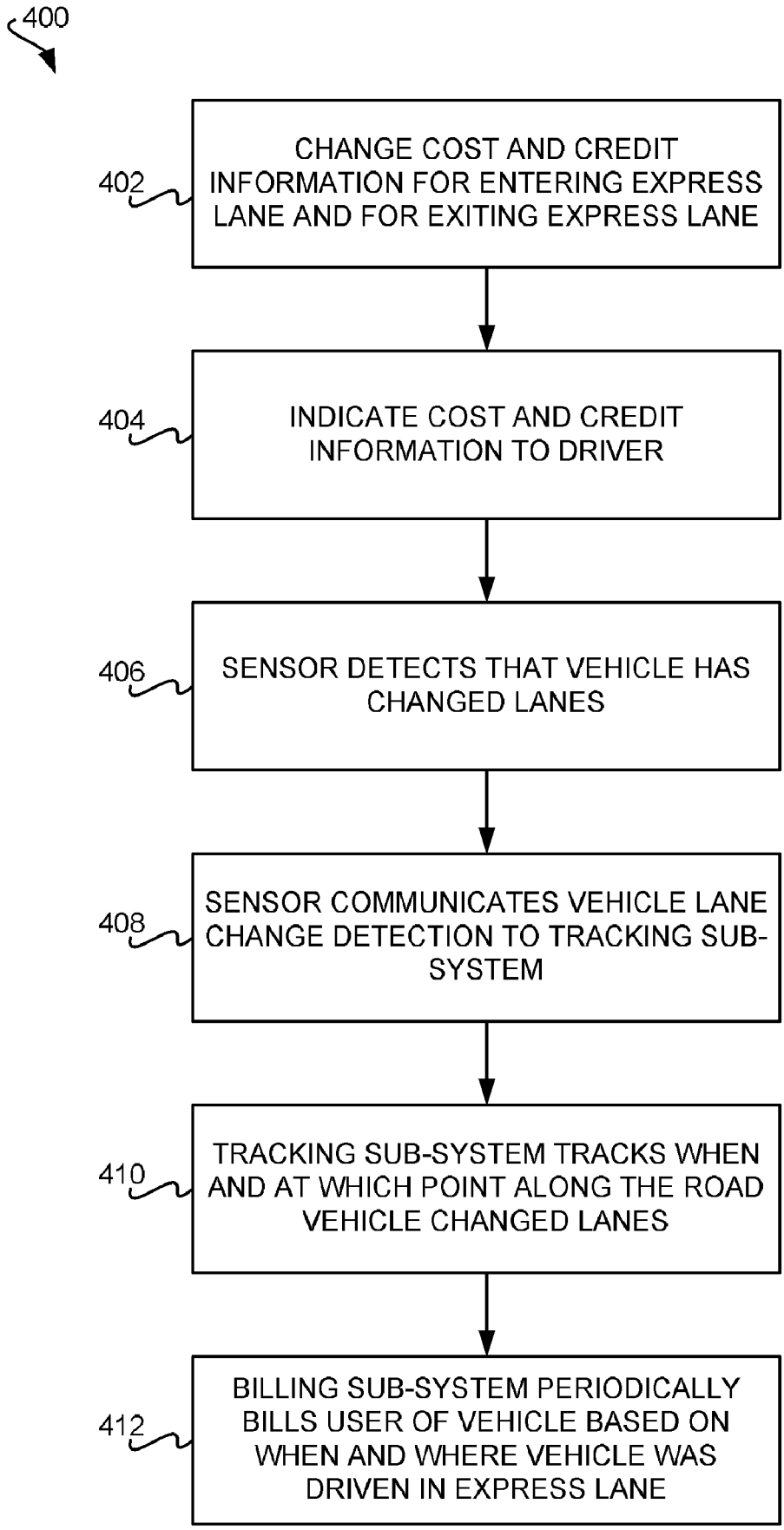
FIG. 4 is a flowchart of a method for tracking and billing vehicle usage of an express lane of a road, according to an embodiment of the invention.

FIG. 4 shows a method 400 that summarizes tracking of vehicle usage of the express lane 104B of a road 102, according to an embodiment of the invention. The control sub-system 206 changes the cost and credit information for entering the express lane 104B and for exiting the express lane 104B (402), based, for instance, on real-time traffic conditions of the road 102. This cost and credit information is indicated to the driver of the vehicle 110 (404). For example, display devices, such as the display device 204A, may display this information to the driver, or wireless transmitters, such as the wireless transmitter 202A, may transmit this information to a corresponding wireless receiver 304 within the vehicle 110.

Once the user has decided to change lanes, such as from the lane 104A to the lane 104B or vice-versa, one of the sensors 108, such as the sensor 108A, detects that the vehicle 110 has changed lanes (406). For instance, the sensor 108A detects the position of the vehicle 110 based on the signal emitted by the transponder 302. As one example, an increase in the strength and/or frequency of the signal may imply that the transponder 302, and hence the vehicle 110, is getting closer to the sensor 108A, and a loss in the strength and/or frequency of the signal may imply that the transponder 302, and hence the vehicle 110, is moving farther away from the sensor 108A. Depending on which side of the road 102 the sensor 108A is located, this information can be used to determine whether the vehicle 110 is changing from the lane 104A to the lane 104B, or vice-versa. The sensor in question communicates this vehicle lane change detection to the tracking sub-system 208 (408).

In turn, the tracking sub-system 208 tracks when and at which point along the road the vehicle 110 has changed lanes (410). For instance, each time a sensor communicates vehicle lane change detection information, the tracking sub-system 208 may add an entry into a database logging the identity of the vehicle 110, the time and date at which the lane change occurred, to which of the lanes 104 the vehicle 110 has entered, and where the vehicle 110 entered the lane in question. The latter information may be obtained based on which sensor reported the lane change detection information, for instance. As a result, the billing sub-system 208 is able to periodically bill the user of the vehicle 110 based on when and where the vehicle 110 was driven in the express lane 104B (412). When and where the vehicle 110 was driven in the express lane 104B is used to extend the appropriate cost (or credit) to the user of the vehicle 110, since the cost (or credit) extended is based on which of the sections 106 the vehicle 110 was in the express lane 104B, and at which times.

Figure 5:
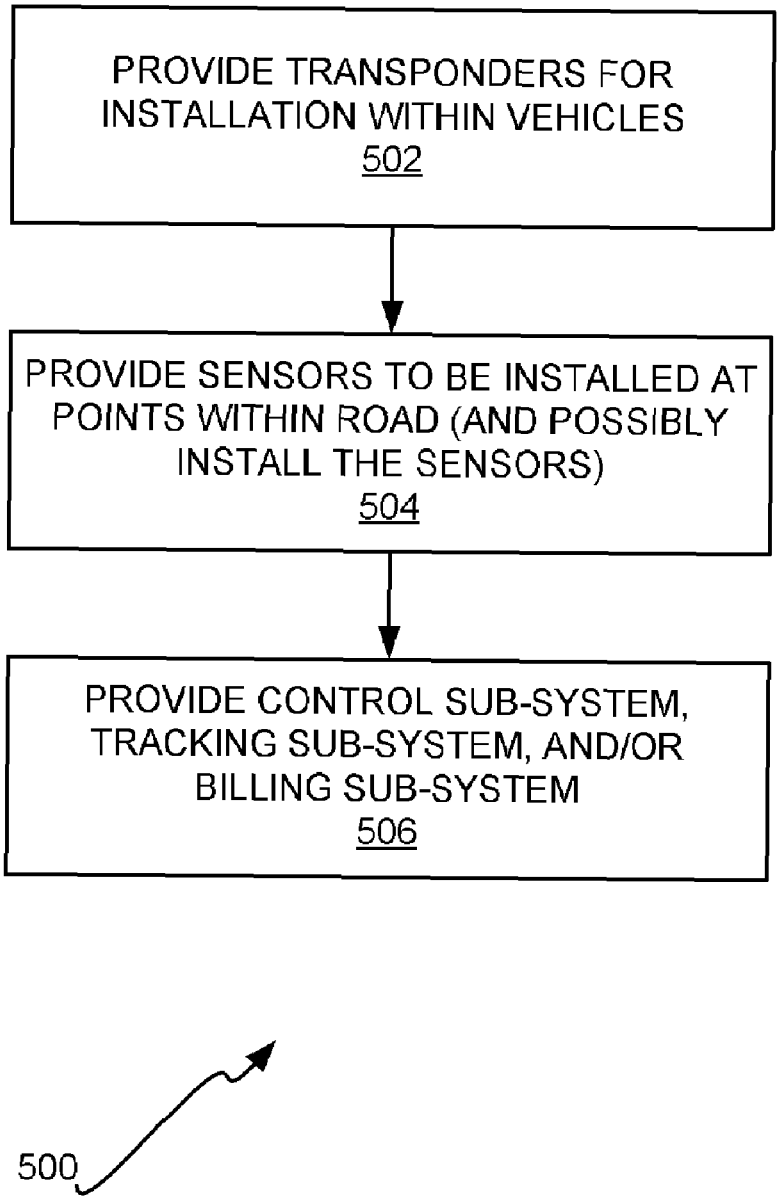
FIG. 5 is a flowchart of a method for providing a system in which usage of vehicles within lanes of a road can be tracked, according to an embodiment of the invention.

FIG. 5 shows a method 500 for providing the system 200 that has been described, according to an embodiment of the invention. For example, service providers may offer the system 200 for sale, for example to municipalities and other governmental or other organizations for installation within roadways. Alternatively, the service providers may install the system 200 for the customers, or may just sell the system 200 for installation to the customer, such that the customer installs the system 200 itself, with possible technical assistance from the service providers.

Therefore, a service provider provides the transponders that are installed within vehicles (502), like the vehicle 110. The service provider may show the customer how to install the transponder within a vehicle, or provide written installation instructions. In turn, the customer or the service provider may install the transponders for vehicle drivers, to provide these instructions to the vehicle drivers for self-installation.

The service provider also provides the sensors 108 to be installed within the road 102 (504). In one embodiment, the service provider just provides the sensors 108 to the organization, and the customer itself installs the sensors 108, with possible technical assistance or supervision from the service provider. In another embodiment, the service provider may itself install the sensors 108 for the organization.

Finally, the service provider may provide the control sub-system 206, the tracking sub-system 208, and/or the billing sub-system 210 that have been described (506). The service provider may install these sub-systems for the customer in one embodiment. In another embodiment, the customer itself may install these sub-systems, with technical assistance and supervision by the service provider as needed.

Figure 6:
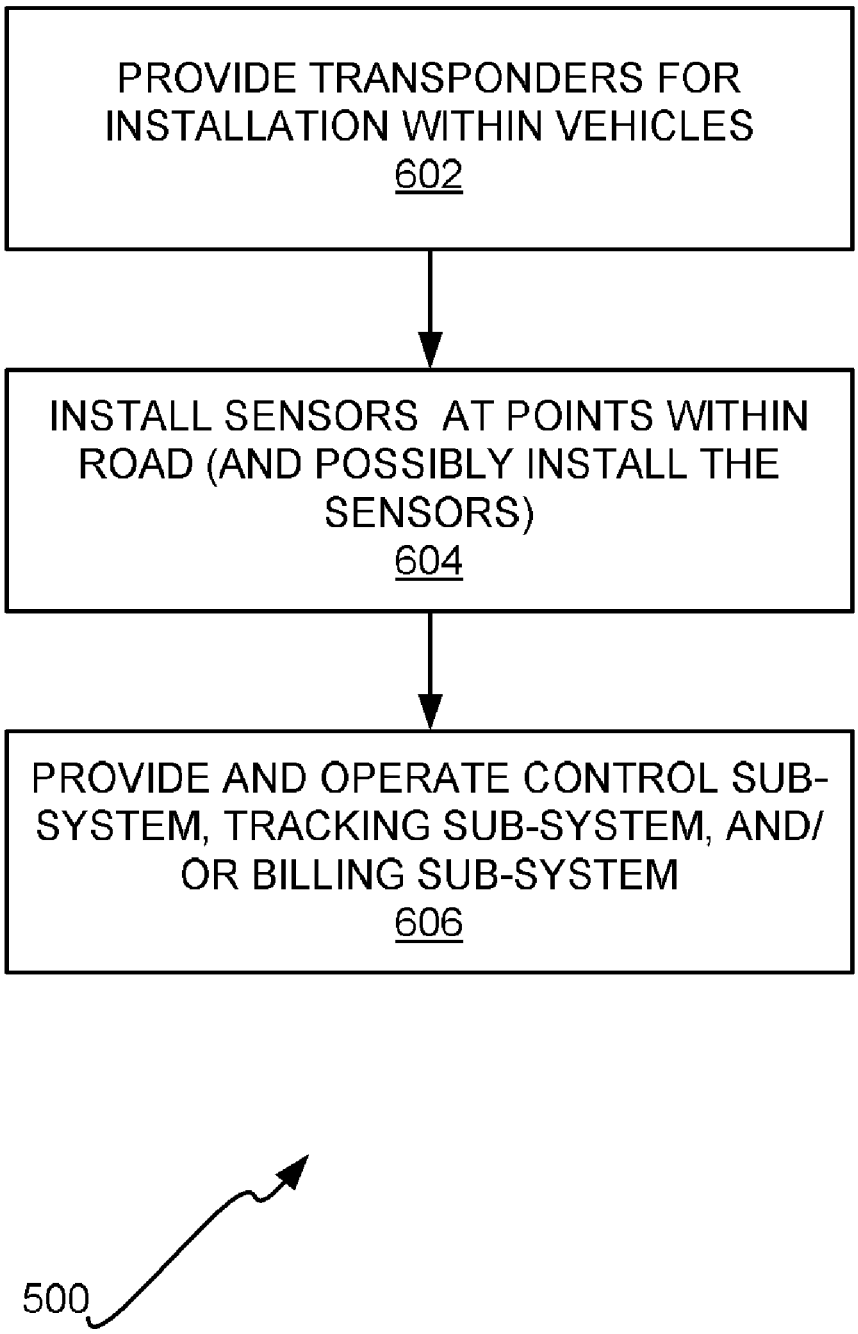
FIG. 6 is a flowchart of a method for providing and operating a system for a customer, where the system tracks usage of vehicles within lanes of a road, according to an embodiment of the invention.

FIG. 6 shows a method 600 for providing the system 200 that has been described, as well as for providing a service for using the system 200, according to an embodiment of the invention. For example, an entity, such as a service provider, may offer the system 200 for sale, such as to municipalities and other governmental or other organizations, where the entity installs the system 200, and operates the system 200 as a service to such customers. The entity first provides the transponders that are installed within vehicles (602), like the vehicle 110. The transponders may be provided to the vehicle drivers for self-installation within their vehicles. Alternatively, the entity may itself install the transponders within the vehicles.

The entity further installs the sensors 108 within the road 102 (504). The entity then provides and operates the control sub-system 206, the tracking sub-system 208, and/or the billing sub-system 210 that have been described (506). That is, the entity may install these sub-systems for the customer, and also operate these sub-systems for the customer. For instance, the customer may pay the entity on a per-vehicle or other basis, such as on a monthly basis, for the service provider to operate these sub-systems for the customer. As such, the entity in effect provides a service to the customer by operating these sub-systems for the customer.

It is noted that, although specific embodiments have been illustrated and described herein, it will be appreciated by those of ordinary skill in the art that any arrangement calculated to achieve the same purpose may be substituted for the specific embodiments shown. This application is thus intended to cover any adaptations or variations of embodiments of the present invention. Therefore, it is manifestly intended that this invention be limited only by the claims and equivalents thereof.

We claim:

1. A system comprising:

one or more transponders, each transponder located in a vehicle capable of being driven on a road having at least a first lane and a second lane in which vehicles move in a same direction;

a plurality of sensors, each sensor located at a point along the road to detect the transponder of each vehicle that has changed between the first and the second lanes of the road at the point; and, a tracking component communicatively coupled to the sensors to track when and at which of the points the vehicles have changed between the first and the second lanes of the road, wherein the sensors comprise:

a first sensor located at a first point along the road to detect the transponder of each vehicle that has changed between the first and the second lanes of the road at the first point, the first point of the road located at a beginning of a first length of the road; and, a second sensor located at a second point along the road to detect the transponder of each vehicle that has changed between the first and the second lanes of the road at the second point, the second point of the road located at a beginning of a second length of the road, wherein the first length of the road is shorter than the second length of the road, wherein within a given time period a cost for a vehicle to drive in the second lane within the first length of the road is a first cost, and within the given time period a cost for a vehicle to drive in the second lane within the second length of the road is a second cost, the second cost being greater than the first cost even within the given time period, wherein the first length of the road is located between the first point and the second point, and no sensors are located between the first sensor at the first point and the second sensor at the second point.

2. The system of claim 1, further comprising a billing component to periodically bill users of the vehicles based on when and where the vehicles are driven in the second lane of the road.

3. The system of claim 1, further comprising a plurality of display devices, each display device situated at a point along the road to inform drivers of the vehicles a cost for switching from the first lane to the second lane at the point along the road.

4. The system of claim 3, wherein each display device is situated with a corresponding sensor in a common enclosure.

5. The system of claim 4, wherein the common enclosure is movable for placement at different points along the road at different times.

6. The system of claim 3, wherein the cost changes based on current traffic conditions on the road.

7. The system of claim 1, further comprising a plurality of wireless transmitters, each wireless transmitter situated at a point along the road to transmit information regarding a cost for switching from the first lane to the second lane at the point along the road.

8. The system of claim 7, further comprising one or more wireless receivers, each wireless receiver located in one of the vehicles in which a transponder is located to receive the information transmitted from the wireless transmitters and convey the information to a driver of the vehicle.

9. The system of claim 7, wherein the cost changes based on current traffic conditions on the road.

10. The system of claim 1, wherein the transponder of each vehicle has an on-off switch to permit a driver of the vehicle to turn on and turn off the transponder.

11. The system of claim 1, further comprising a device disposable in the vehicle capable of being driven on the road having at least the first lane and the second lane in which vehicles move in a same direction, the device comprising:

the transponder to output whether the vehicle is in the first lane or the second lane of the road, such that the transponder communicates with the sensors located at the points along the road to convey at which of the points the vehicle changes between the first and the second lanes of the road.

12. The system of claim 11, wherein the device further comprises a wireless receiver to receive information regarding a cost for switching from the first lane to the second lane at a current point along the road and to convey the information to a driver of the vehicle.

13. A method comprising:

detecting that a vehicle has changed between a first lane and a second lane along a road;

tracking when and at which of the different points the vehicle changed between the first and the second lanes; and, periodically billing a user of the vehicle based on when and where the vehicle was driven in the second lane of the road, wherein where the vehicle is driven in the second lane within a first length of the road at which a first point is located, the driver of the vehicle is assessed a first cost within a given time period, wherein where the vehicle is driven in the second lane within a second length of the road at which a second point is located, the driver of the vehicle is assessed a first cost within the given time period, the second cost being greater than the first cost even within the given time period, wherein the first length of the road is shorter than the second length of the road, wherein the first length of the road is located between the first point and the second point, and no sensors are located between a first sensor at the first point and a second sensor at the second point.

14. The method of claim 13, further comprising indicating to a driver of the vehicle a cost for switching from the first lane to the second lane at each different point along the road.

15. The method of claim 14, further comprising changing the cost for switching from the first lane to the second lane at each different point along the road based on current traffic conditions on the road.

16. A method comprising:

providing one or more transponders for installation in vehicles to be driven on a road having at least a first lane and a second lane in which the vehicles move in a same direction;

providing a plurality of sensors, each sensor to be installed at a point along the road to detect the transponder of each vehicle that has changed between the first and the second lanes of the road at the point; and, providing a tracking component that is to be communicatively coupled to the sensors to track when and at which of the points the vehicles have changed between the first and the second lanes of the road, wherein the sensors comprise:

a first sensor located at a first point along the road to detect the transponder of each vehicle that has changed between the first and the second lanes of the road at the first point, the first point of the road located at a beginning of a first length of the road; and, a second sensor located at a second point along the road to detect the transponder of each vehicle that has changed between the first and the second lanes of the road at the second point, the second point of the road located at a beginning of a second length of the road, wherein the first length of the road is shorter than the second length of the road, wherein within a given time period a cost for a vehicle to drive in the second lane within the first length of the road is a first cost, and within the given time period a cost for a vehicle to drive in the second lane within the second length of the road is a second cost, the second cost being greater than the first cost even within the given time period, wherein the first length of the road is located between the first point and the second point, and no sensors are located between the first sensor at the first point and the second sensor at the second point.

17. The method of claim 16, wherein providing the plurality of sensors comprises installing each sensor at a corresponding point along the road to detect the transponder of each vehicle that has changed between the first and the second lanes of the road at the corresponding point.

18. The method of claim 16, further comprising providing a billing component to periodically bill users of the vehicles based on when and where the vehicles are driven in the second lane of the road.

19. A method comprising:

providing a transponder for installation in a vehicle to be driven on a road having at least a first lane and a second lane in which the vehicle move in a direction;

installing a plurality of sensors at points along the road to detect the transponder of the vehicle that has changed between the first and the second lanes of the road at any of the points; and, providing and operating a tracking component, the tracking component communicatively coupled to the sensors to track when and at which of the points the vehicles have changed between the first and the second lanes of the road, wherein the sensors comprise:

a first sensor located at a first point along the road to detect the transponder of each vehicle that has changed between the first and the second lanes of the road at the first point, the first point of the road located at a beginning of a first length of the road; and, a second sensor located at a second point along the road to detect the transponder of each vehicle that has changed between the first and the second lanes of the road at the second point, the second point of the road located at a beginning of a second length of the road, wherein the first length of the road is shorter than the second length of the road, wherein within a given time period a cost for a vehicle to drive in the second lane within the first length of the road is a first cost, and within the given time period a cost for a vehicle to drive in the second lane within the second length of the road is a second cost, the second cost being greater than the first cost even within the given time period, wherein the first length of the road is located between the first point and the second point, and no sensors are located between the first sensor at the first point and the second sensor at the second point.

20. The method of claim 19, farther comprising providing a billing component to periodically bill users of the vehicles based on when and where the vehicles are driven in the second lane of the road.

* * * * *